United States Patent [19]

Roberts

[11] 4,171,670

[45] Oct. 23, 1979

[54] OVERHEAD RAIL TRANSPORTATION SYSTEMS

[75] Inventor: Richard A. Roberts, Burnaby, Canada

[73] Assignee: H. Arnold Seed, Port Moody, Canada

[21] Appl. No.: 835,812

[22] Filed: Sep. 22, 1977

[51] Int. Cl.[2] ..... B61B 3/02; E01B 25/22

[52] U.S. Cl. ..... 104/93; 104/89; 104/107; 104/109; 104/246; 105/148; 105/153

[58] Field of Search ..... 104/89, 91, 93, 106, 104/107, 109, 246; 105/30, 148, 150, 153

[56] References Cited

U.S. PATENT DOCUMENTS

| | | | |
|---|---|---|---|
| 1,106,102 | 8/1914 | Lindemann | 104/93 |
| 3,092,039 | 6/1963 | Lich | 104/93 X |
| 3,101,678 | 8/1963 | Grube | 105/153 X |
| 3,252,429 | 5/1966 | Atanasoff et al. | 104/93 X |
| 3,446,158 | 5/1969 | Pettit | 105/153 X |
| 3,625,158 | 12/1971 | Lorenz et al. | 104/93 |
| 3,854,407 | 12/1974 | Cocroft | 104/93 X |
| 3,935,822 | 2/1976 | Kaufmann | 104/93 |

*Primary Examiner*—Randolph A. Reese

*Attorney, Agent, or Firm*—Larson, Taylor & Hinds

[57] ABSTRACT

A rail having an upper supporting edge and a lower braking edge, and a traction unit for riding on the rail and adapted to be connected to a carrier so as to suspend the carrier from the rail. This traction unit has a power-driven wheel to ride on the rail upper edge, and a plurality of braking wheels positioned close enough to the lower edge of the rail to prevent the traction wheel from jumping off the upper edge thereof, and a brake system for each brake wheel. A substantially C-shaped arm is pivotally connected to the traction unit near the top therecf and extends downwardly and around the rail and has a lower end extending across the plane of the rail, to which the carrier is connected.

21 Claims, 7 Drawing Figures

Figure 4:
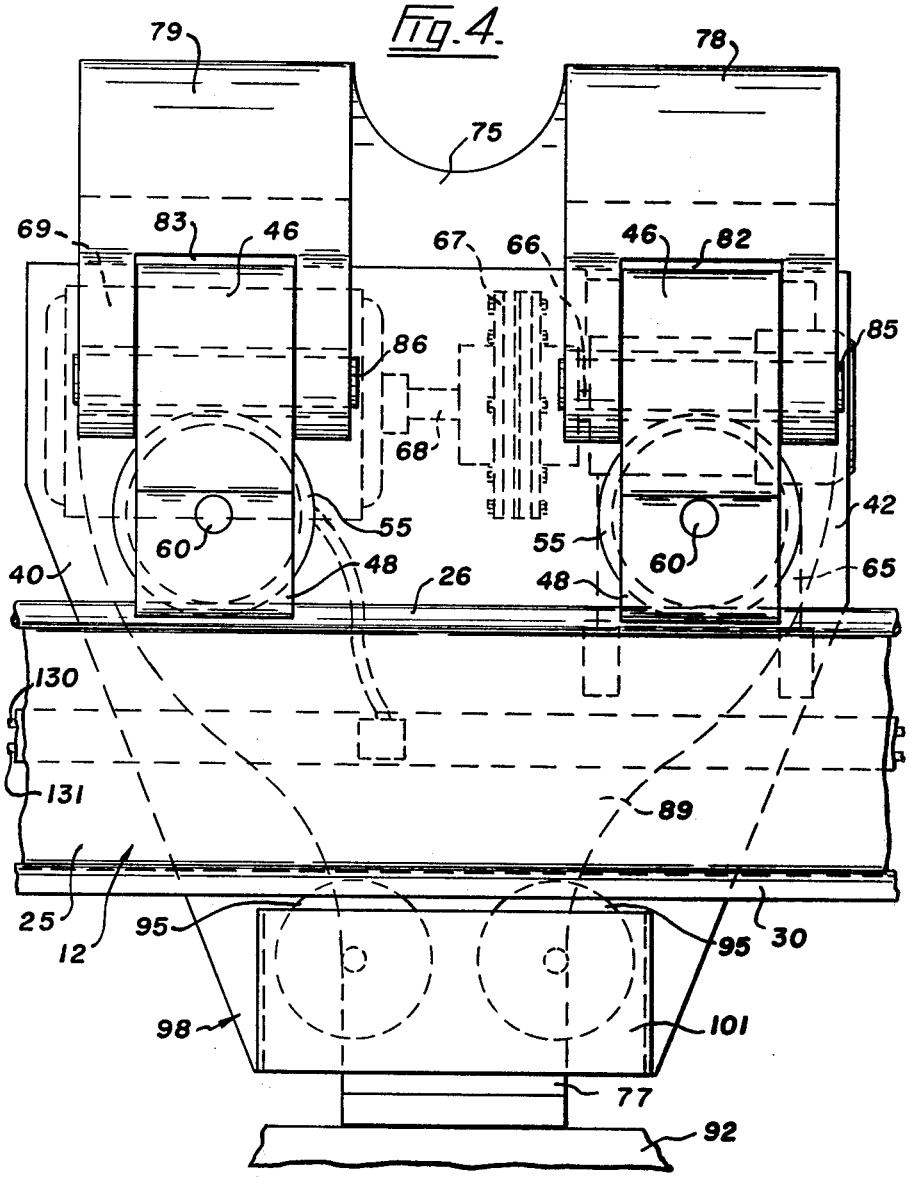

Fig. 1.
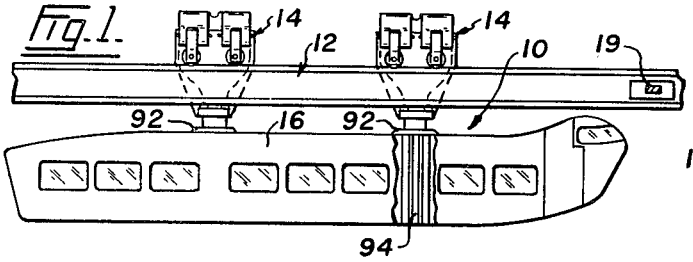
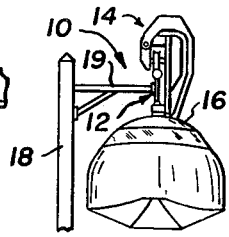
Fig. 2.
Fig. 3.
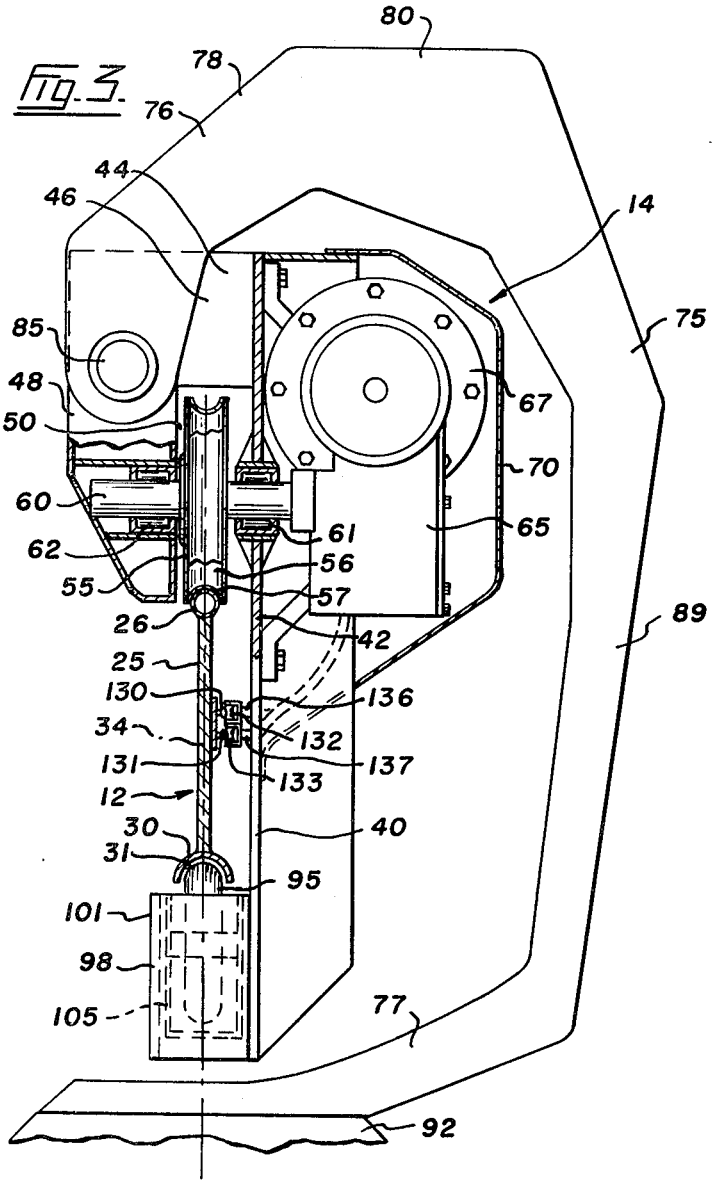

79
78
75
69
83
46
67
66
46
82
86
85
68
42
55
55
60
60
40
48
26
48
65
130
131
89
25
12
95
95
30
98
101
77
92

OVERHEAD RAIL TRANSPORTATION SYSTEMS

This invention relates to overhead rail transportation systems and particularly to monorail systems for short distance and long distance transportation of passengers, although it may be used for the transportation of freight, ores and other purposes.

There is a great search going on for a mass transportation system particularly for urban areas, and new rapid transportation systems are needed for long distance travel and haulage. The vast number of automobiles and trucks on the road, and the concentration of huge members of people in urban areas have made it necessary to provide mass transportation in order to reduce the number of individual vehicles in use. Bus systems are helping to eliminate the problem, but the number of buses now on the roads is in itself creating a problem. In addition, there is the problem of air pollution resulting from the large number of internal combustion engines operating throughout the days and nights.

The cost of updating and maintaining new railroad rights-of-way, and the cost of underground systems seem to indicate that overhead rail transportation offers the most likely solution. There has, however, been a great deal of effort in this direction, but there does not seem to be a satisfactory system in operation anywhere. The prior monorail systems seem to be too cumbersome and inflexible, too costly and/or not safe.

The main object of the present invention is to provide a rapid transportation system which is safe, economical and efficient, with minimum noise and vibration, and with a minimum ecological disturbance.

These objectives are accomplished by a transportation system including a rail to be supported in an overhead position, and a traction unit for riding on the rail and adapted to be connected to a carrier, such as a passenger vehicle, a freight vehicle or any other unit for carrying a load. The traction unit has at least one traction wheel to ride on an upper edge of the rail, and braking wheels positioned so near the lower edge of the rail as to prevent the traction wheel from jumping off it. Thus, the braking wheels act as safety devices as well as braking devices for the unit. The braking wheels are spaced apart longitudinally of the rail so as to resist any tumbling action in the traction unit when braking is taking place. The traction unit also includes a substantially C-shaped suspension arm pivotally connected thereto above the rail and shaped to extend around and below the latter where it is connected to a carrier. The shape and mounting of the suspension arm are such that all of the weights carried by the traction unit resolve into a vertical force down through the traction wheel, the rail and the braking wheels. The traction unit remains vertically aligned with the rail when the carrier is subjected to transverse forces, such as centrifugal force as the unit moves around a curve, while the arm and carrier pendulate so as to keep the resultant forces in proper alignment with wheels and the track.

A rail transportation system according to this invention comprises a rail to be supported in an overhead position and having an upper supporting edge and a lower braking edge spaced from said upper edge, and a traction unit for riding on the rail and adapted to be connected to a carrier to suspend said carrier from the rail; said traction unit comprising a supporting frame, said frame when the traction unit is in operation being located beside the rail, at least one traction wheel journalled on the frame and positioned to ride on the rail upper edge, power means on the frame and connected to the traction wheel to drive said wheel along the upper edge of the rail, braking means on the frame and normally positioned close enough to the lower edge of the rail to prevent the traction wheel from jumping off the upper edge thereof, and a brake operator connected to the brake means and operable to cause said brake means firmly to engage the rail lower edge and to brake the traction unit.

More specifically, this rail transportation system comprises a rail to be supported in an overhead position and having an upper supporting edge and a lower braking edge spaced from said upper edge, and a traction unit for riding on the rail and adapted to be connected to a carrier to suspend said carrier from the rail; said traction unit comprising a supporting frame having a main section to extend downwardly beside the rail and a head section connected to the main section near an upper edge thereof and extending outwardly therefrom and downwardly in spaced relationship thereto to form a passageway therebetween, a shaft journalled in the main section and the head section and extending across the passageway, a traction wheel fixedly mounted on the shaft in the passageway to ride on the rail upper edge, power means on the frame and connected to said shaft to drive the traction wheel along the rail edge, braking means on the main section and normally positioned close enough to the lower edge of the rail to prevent the traction wheel from jumping off the upper edge thereof, a brake operator connected to the brake means and operable to cause said brake means firmly to engage the rail lower edge and to brake the traction unit, and a suspension arm having an upper end connected to the supporting frame above the rail and a lower end to be connected to the carrier, said arm being shaped so that all of the weights carried by the traction wheel resolve into a vertical force down through said wheel, the rail and said braking means.

Figure 5:
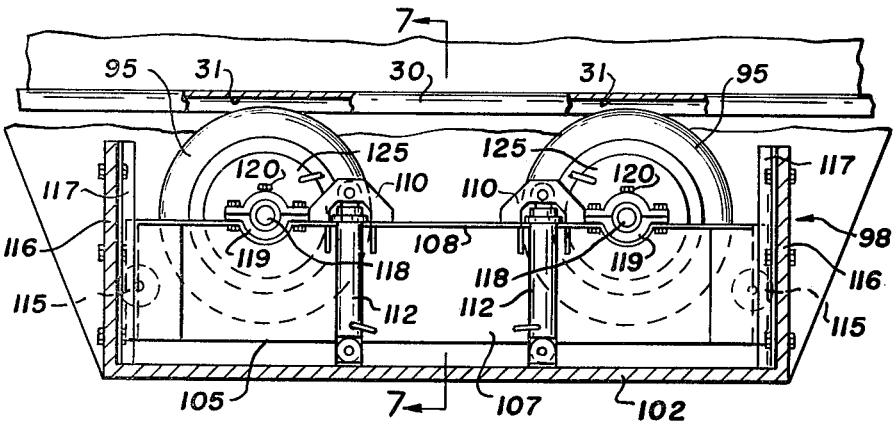
Figure 6:
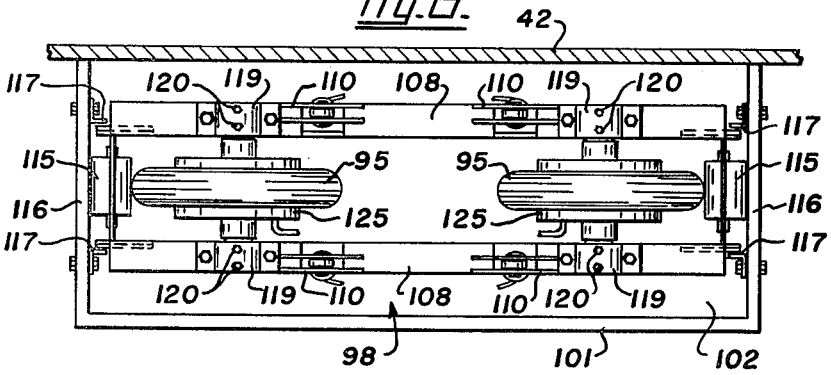
Figure 7:
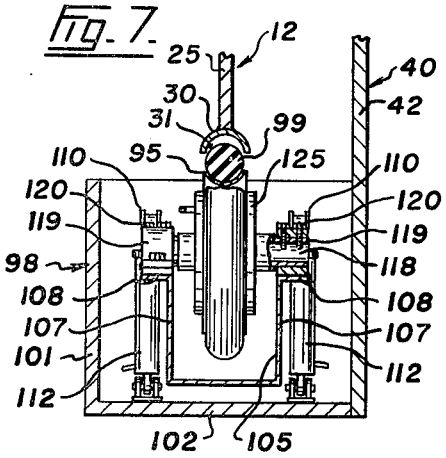

A preferred form of this invention is illustrated by way of example in the accompanying drawings, in which:

FIG. 1 is a side elevation diagrammatically illustrating a rail, and a passenger car supported by a pair of traction units, FIG. 2 is a front end elevation of the apparatus of FIG. 1, FIG. 3 is an enlarged end elevation of the traction unit, partly in section, mounted on the rail, FIG. 4 is a side elevation of the traction unit illustrated in FIG. 3, FIG. 5 is a further enlarged side elevation of the braking component of the traction unit, FIG. 6 is a plan view of the component shown in FIG. 5, and FIG. 7 is a cross section taken on the line 7—7 of FIG. 5.

Referring to FIGS. 1 and 2 of the drawings, 10 is an overhead rail transportation system in accordance with this invention and including a rail 12 and identical traction units 14 riding on the rail and connected to a carrier 16 which in this form of the invention is a passenger vehicle. If the carrier is relatively short, only one traction unit will be required, but if the carrier is relatively long, two or more units are needed, as shown. The rail is supported in an overhead position in any suitable manner, and in this example, a plurality of vertical pylons 18 are provided for this purpose, each pylon having a horizontal arm 19 projecting outwardly therefrom and carrying the rail 12 at its outer end. Each arm 19 is long enough to permit the carrier or car 16 to clear the pylons, as shown in FIG. 2.

FIGS. 3 and 4 illustrate rail 12 and traction unit 14 in detail.

Rail 12 is made up of a web 25 having an enlarged upper supporting edge 26 which is preferably circular in cross section as shown. This edge may be formed by a tube extending along and welded to adjacent edge of web 25. This web is also formed with a lower braking edge 30 which is preferably concave in cross section to form a groove 31 facing downwardly from the rail. The edge 30 may be formed by half of a pipe welded to the adjacent edge of web 25. Rail 12 has a center line 34 which extends substantially through the circular upper edge 26, web 25 and the concave lower edge 30. If edge 26 is of tubular construction, electrical heating elements may extend therethrough to prevent the formation of ice on the track in the winter time.

Traction unit 14 includes a supporting frame 40 having a main section 42 which extends downwardly along one side of track 12 and above and below the latter, and a head section 44. This head section is secured to main section 42 near the upper edge thereof, and extends outwardly and downwardly from said main section. The head section is actually formed by a horizontal block 46 secured to and extending outwardly from frame section 42, and a downwardly extending support 48. This support is spaced outwardly from main section 42 to form a passageway 50 therebetween. Head support 48 lies on the opposite side of track 12 from the frame main section 42, while passageway 50 lies over the rail and is on the center line 34. At least one traction wheel 55 is positioned in passageway 50 and rides on the upper edge 26 of rail 12. This wheel is formed with a peripheral groove 56 preferably covered by a lining 57 formed of suitable long-wearing, sound-absorbing material, such as nylon. The radius of the peripheral groove 56 is substantially the same as that of upper edge 26 of the rail so that the traction wheel 55 rides on the rail and cannot shift laterally off it. In addition, if the traction wheel becomes inclined relative to the rail edge, it still maintains full contact with the circular edge.

Traction wheel 55 is fixedly mounted on a shaft 60 extending across passageway 50 and journalled in bearings 61 and 62 carried by frame section 42 and head support 48, respectively. There may be only one traction wheel 55 in which case its shaft 60 is driven, and there may be a plurality of these traction wheels with one or all of the axles thereof driven. In any case, the traction wheel shown in FIG. 3 and shown to the right of FIG. 4 is driven. The shaft or axle in this example is connected to the output shaft of a reduction gear unit 65, the input shaft 66 of which is connected by resilient couplings 67 to the power shaft 68 of an electric motor 69. Reduction unit 65 and motor 69 are mounted on frame section 42 of supporting frame 40. A cover 70 is mounted on the frame and encloses these units.

A suspension arm 75, which is substantially of C-shaped configuration, has an upper end 76 and a lower end 77. In this example, the upper end 76 of the suspension arm is divided into two spaced-apart sections 78 and 79 which extend downwardly from horizontal portion 80 of the arm. This portion 80 is above and extends across the top of frame 40, while end sections 78 and 79 extend downwardly from said portion on the opposite of center line 34 from main section 42 of the supporting frame. The arm ends 78 and 79 are bifurcated as indicated at 82 and 83 in FIG. 4, and these bifurcated ends are mounted on aligned pins 85 and 86 carried by support 48 or frame head 44.

Suspension arm 75 has a downwardly-extending portion 89 which is connected to arm lower end 77, said end being substantially horizontal and extending across center line 34, as clearly shown in FIG. 3.

The carrier 16 is connected to the lower end 77 of suspension arm 75, and any suitable shock absorber and spring attachment may be provided between this arm and the carrier, as indicated at 92 in FIG. 1. A suspension ring 94 is provided in carrier 16, to which suspension arm 75 is connected through the spring arrangement 92.

Suitable means is provided for braking each traction unit 14 and for preventing the traction wheels thereof from jumping off the upper edge of rail 12. At least two braking wheels 95 are provided for this purpose. As these wheels are identical, only one will now be described in detail.

Braking wheel 95 is mounted on a base unit 98 which, in turn, is mounted on the main section 42 of frame 40 near the lower edge thereof, see FIGS. 5, 6 and 7. This base unit projects outwardly from the frame across the center line 34 below track 12. Wheel 95 has a resilient tire 99 thereon, and this tire projects into groove 31 of the lower edge 30 of rail 12. If the braking wheel is immovable vertically, the tire engages the track edge at all times. However, if the wheel can be shifted vertically, as preferred, then the tire normally is spaced a little from the bottom of groove 31, as shown in FIG. 3, but it will always be within the groove. In other words, wheel 95 is close enough to the braking edge 30 of rail 12 that traction wheel 55 cannot jump off the supporting edge 26 of the rail. The wheels 55 and 95 are opposed to each other, and the distance between them is normally such that the traction wheels cannot jump off the rail and the braking wheel cannot come out of the groove in the rail lower edge.

In this example, base unit 98 is in the form of an open-topped outer casing 101 which is secured along its inner side to section 42 of frame 40, and has a bottom 102. An inner casing 105 is mounted for vertical movement within casing 101. Casing 105 has transversely spaced walls 107 with outwardly extending flanges 108 at their upper edges. A plurality of brackets 110 are mounted on flanges 108, and extensible hydraulic units 112 are mounted on their lower ends on outer casing bottom 102 and are connected at their upper ends to brackets 110. As units 112 are extended and retracted, inner casing 105 moves upwardly and downwardly, respectively, relative to outer casing 101. If desired, inner casing may be provided with rollers 115 at its opposite ends which bear against adjacent end walls 116 of casing 101 to prevent longitudinal movement of the inner casing while permitting vertical movement thereof. These rollers are confined between vertical bars 117 mounted on walls 116 within casing 101.

Each braking wheel 95 is freely mounted on a shaft or axle 118 which is carried at its opposite ends by bearings 119 mounted on flanges 108. Locking pins 120 are provided between bearings 119 and shaft 118 to prevent the latter from rotating.

A brake assembly 125 is preferably provided for each braking wheel 95, although one of these wheels may be an idler without a brake assembly. Any suitable braking system may be used, such as a conventional brake drum assembly operated hydraulically or electrically.

As stated above, there may be one or more traction units 14 for each carrier 16. Each traction unit has one or more traction wheels, at least one of which is driven, but each one may be driven. The traction unit has two or more braking wheels, and these are spaced apart longitudinally of the track so as to reduce any tendency of the traction unit tipping forwardly when the brakes are applied.

Electrical power may be supplied to the traction units and carriers in any desired manner. For example, FIG. 3 shows electrical conductors 130 and 131 mounted on and insulated from the side of rail 12, and pick-up rollers 132 and 133 mounted on and insulated from frame 40 in a position to ride upon conductors 130 and 131. Insulated electrical conductors 136 and 137 form part of an electrical circuit including rollers 132 and 133 and the motor or motors of the traction unit. Suitable conducting means (not shown) are provided for carrying electricity down to the carrier 16. Similarly, hydraulic or electrical controls extend from the carrier or car to each traction unit to operate the hydraulic units 112 and the brake assemblies 125 thereof. As these controls do not form part of the present invention, they are not described herein.

The carrier or passenger car 16 shown in FIGS. 1 and 2 has two traction units 14 suspending from track 12. The traction wheels of these units are driven by reversible electric motors to propel the car along the rail. As stated above, the braking wheels 95 riding in groove 31 of the lower edge of the rail prevent the traction wheels from jumping off the upper edge of said rail. When it is desired to slow down or stop the car, the brake operating mechanism is manipulated and this first causes hydraulic units 112 to extend thereby pressing braking wheels 95 against the lower braking edge of the track. At the same time, brake assemblies 125 are operated to brake wheels 95 so that the traction units and, consequently, the carrier car are slowed down and stopped. As there are at least two braking wheels in each traction unit, they resist any inclination the traction unit may have to tip forwardly during the braking action. The shape of the suspension arm 89 and the location of suspension pins 85,86 result in the weights of all of the components carried by the traction wheel resolving into a vertical force down through the traction wheel, the rail and the braking wheels mainly along the center line 34. As track 12 is banked at curves, the center line is inclined in these areas so that the resultant force is down the center line. The pivotal mounting of the C-arms of the traction units permit the carrier to swing outwardly on curves, but transverse forces on the carrier do not work against the traction and braking wheels or, in other words, do not tend to derail the traction units.

The construction of these traction units is such that if the carriers are detachably connected thereto, the units can travel along the track when the carrier has been disconnected therefrom. This feature is particularly useful if the carriers are in the form of containers carrying commercial loads.

For the sake of safety, the braking system of this traction unit can be hydraulically and/or electrically powered. When two brake power systems are supplied, one would normally be used, and the second one would come into action if the first one failed. For example, it would be desirable to have both a hydraulic system and an electric system. If electric power to the unit failed the hydraulic system would automatically come into action.

When the brakes are to be applied, it is preferable to raise the trailing brake wheel 95 of each traction unit 14 a little ahead of the leading brake wheel thereof, and to apply the brake of said trailing wheel first to obviate the possibility of somersault or tumbling stresses.

I claim:

1. A rail transportation system comprising a rail to be supported in an overhead position and having an upper supporting edge and a lower braking edge spaced from said upper edge, and a traction unit for riding on the rail and adapted to be connected to a carrier to support said carrier from the rail; said traction unit comprising a supporting frame, said frame, when the traction unit is in operation, being located beside the rail, at least one traction wheel journalled on the frame and positioned to ride on the rail upper edge, a suspension arm having an upper end connected to the supporting frame above the rail and a lower end to be connected to the carrier, said arm being shaped so that all of the weights carried by the traction wheel resolve into a vertical force down through said wheel, the rail and said braking means; pivot means connecting the upper end of said arm to the frame to permit lateral swinging movement of the arm relative to the rail, power means on the frame and connected to the traction wheel to drive said wheel along the upper edge of the rail, braking means on the frame and normally positioned close enough to the lower edge of the rail to prevent the traction wheel from jumping off the upper edge thereof, and a brake operator connected to the brake means and operable to cause said brake means firmly to engage the rail lower edge and to brake the traction unit.

2. A transportation system as claimed in claim 1 in which said brake means is normally spaced from the rail lower edge, and includes means to cause the brake means to engage said lower edge while braking the traction unit.

3. A transportation system as claimed in claim 1 comprising a shaft upon which said traction wheel is mounted, said shaft being carried by said supporting frame and said power means being connected to an end of the shaft, and said arm being shaped to extend across the plane of the rail above the rail, down past the rail and back across the rail plane below the rail.

4. A transportation system as claimed in claim 1 comprising a shaft upon which said traction wheel is mounted, said shaft having first and second ends carried by said supporting frame, said power means being connected to the first end of the shaft and said arm being shaped to extend across the plane of the rail above the rail, down past the rail and back across the rail plane below the rail, and said pivot means being on the same side of the traction wheel as and above the second end of the shaft.

5. A transportation system as claimed in claim 1 in which said braking means comprises at least one brake wheel journalled on the frame and positioned to engage the rail lower edge, and a brake assembly for said brake wheel.

6. A transportation system as claimed in claim 1 in which said braking means comprises a plurality of brake wheels journalled on the frame spaced apart longitudinally of the rail and positioned to engage the rail lower edge, and a brake assembly for at least one of said brake wheels.

7. A transportation system as claimed in claim 1 in which said braking means comprises at least one brake wheel journalled on the frame and positioned to engage the rail lower edge, said brake wheel normally being spaced from the rail lower edge and being movable towards and away from said lower edge, a brake assembly for said brake wheel, and means for moving the brake wheel into engagement with the rail lower edge when said brake assembly is operated to brake the wheel.

8. A transportation system as claimed in claim 7 in which said lower edge of the rail is enlarged relative to the rail and has a concave cross sectional surface facing downwardly, and said brake wheel has a periphery shaped to fit within said concave surface.

9. A transportation system as claimed in claim 7 comprising an outer casing mounted on the supporting frame near the lower edge thereof and underlying the rail, an inner casing mounted for vertical movement within the outer casing, a shaft extending across said inner casing, said braking wheel being mounted on the shaft, and power means connected between the inner casing and the outer casing and operable to move the inner casing upwardly when the brake assembly is operated.

10. A transportation system as claimed in claim 9 in which said power means comprises an extensible hydraulic unit connected at one end to the outer casing and at an opposite end to the inner casing.

11. A transportation system as claimed in claim 9 in which said power means comprises an extensible hydraulic unit connected at one end to the outer casing and at an opposite end to the inner casing.

12. A transportation system as claimed in claim 1 in which said braking means comprises a plurality of brake wheels journalled on the frame spaced apart longitudinally of the rail and positioned to engage the rail lower edge, said brake wheels normally being spaced from the rail lower edge and being movable towards and away from said lower edge, a brake assembly for each brake wheel, and means for moving each brake wheel into engagement with the rail lower edge when the brake assembly of said each wheel is operated to brake the latter wheel.

13. A transportation system as claimed in claim 12 comprising an outer casing mounted on the supporting frame near the lower edge thereof and underlying the rail, an inner casing mounted for vertical movement within the outer casing, a shaft for each braking wheel extending across said inner casing and upon which said each braking wheel is mounted, and power means connected between the inner casing and the outer casing and operable to move the inner casing upwardly when the brake assemblies of the wheels are operated.

14. A transportation system as claimed in claim 1 in which said upper edge of the rail is enlarged relative to the rail and is of circular cross section, and said traction wheel has a concave peripheral wall to fit over said upper edge.

15. A rail transportation system comprising a rail to be supported in an overhead position and having an upper supporting edge and a lower braking edge spaced from said upper edge, and a traction unit for riding on the rail and adapted to be connected to a carrier to support said carrier from the rail; said traction unit comprising a supporting frame having a main section to extend downwardly beside the rail and a head section connected to the main section near an upper edge thereof and extending outwardly therefrom and downwardly in spaced relationship thereto to form a passageway therebetween, a shaft journalled in the main section and the head section and extending across the passageway, a traction wheel fixedly mounted on the shaft in the passageway to ride on the rail upper edge, power means on the frame and connected to said shaft to drive the traction wheel along the rail edge, braking means on the main section and normally positioned close enough to the lower edge of the rail to prevent the traction wheel from jumping off the upper edge thereof, a brake operator connected to the brake means and operable to cause said brake means firmly to engage the rail lower edge and to brake the traction unit, and a suspension arm having an upper end connected to the supporting frame above the rail, a pin carried by the head section of the frame, the upper end of said arm being mounted on the pin so the arm can swing relative to the supporting frame, and said arm being substantially C-shaped and extending generally upwardly from the pin and around to a lower end below the frame and extending across the plane of the traction wheel, said lower end to be connected to the carrier, said shape of said arm being such that all of the weights carried by the traction wheel resolve into a vertical force down through said wheel, the rail and said braking means.

16. A transportation system as claimed in claim 15 in which said braking means comprises at least one brake wheel journalled in the main section of the frame and positioned to engage the rail lower edge, and a brake assembly for said brake wheel.

17. A transportation system as claimed in claim 16 in which said lower edge of the rail is enlarged relative to the rail and has a concave cross sectional surface facing downwardly, and said brake wheel has a periphery shaped to fit within said concave surface.

18. A transportation system as claimed in claim 15 in which said braking means comprises at least one brake wheel journalled in the main section of the frame and positioned to engage the rail lower edge, said brake wheel normally being spaced from the rail lower edge and being movable towards and away from said lower edge, a brake assembly for said brake wheel, and means for moving the brake wheel into engagement with the rail lower edge when said brake assembly is operated to brake the wheel.

19. A transportation system as claimed in claim 15 in which said braking means comprises a plurality of brake wheels journalled on the main section of the frame spaced apart longitudinally of the rail and positioned to engage the rail lower edge, and a brake assembly for at least one of said brake wheels.

20. A transportation system as claimed in claim 15 in which said braking means comprises a plurality of brake wheels journalled on the main section of the frame spaced apart longitudinally of the rail and positioned to engage the rail lower edge, said brake wheels normally being spaced from the rail lower edge and being movable towards and away from said lower edge, a brake assembly for each brake wheel, and means for moving each brake wheel into engagement with the rail lower edge when the brake assembly of said each wheel is operated to brake the latter wheel.

21. A transportation system as claimed in claim 15 in which said upper edge of the rail is enlarged relative to the rail and is of circular cross section, and said traction wheel has a concave peripheral wall to fit over said upper edge.

* * * * *